US005159956A

United States Patent [19]

Kurihara

[11] Patent Number: 5,159,956

[45] Date of Patent: Nov. 3, 1992

[54] HERMETICALLY SEALED WATER PIPE CLEANING DEVICE

[76] Inventor: Yoshikuni Kurihara, 7-12, Goryo-machi, Higashimatsuyama-shi, Saitama-ken, Japan

[21] Appl. No.: 516,121

[22] Filed: Apr. 27, 1990

Related U.S. Application Data

[63] Continuation-in-part of Ser. No. 323,418, Mar. 14, 1989, abandoned.

[30] Foreign Application Priority Data

Mar. 16, 1988 [JP] Japan ..... 63-34874

[51] Int. Cl.[5] ..... F28G 9/00

[52] U.S. Cl. ..... 137/624.13; 165/95; 134/169 C

[58] Field of Search ..... 165/95; 137/624.13, 137/624.15, 563; 134/166 C, 169 C

[56] References Cited

U.S. PATENT DOCUMENTS 4,699,665 10/1987 Scharton ..... 165/95

4,773,357 9/1988 Scharton ..... 165/95

*Primary Examiner*—Alan Cohan

*Attorney, Agent, or Firm*—Fleit, Jacobson, Cohn, Price, Holman & Stern

[57] ABSTRACT

A cleaning device for heat exchangers mounted on construction machines such as a bulldozer, for example, and for water pipe that can be cleaned without removing the heat exchanger or pipe from a machine, includes a cleaning water storage tank (1) connected to a pump (2) for pumping water under pressure to a heat exchanger (a) through pressure and flow regulating valves (31, 32) and a gas-liquid mixer (5) to which gas is fed from tank (6) for pulsating and producing gas bubbles in the water flow for effecting the cleaning. Flow control valves (7, 9) control the direction of flow through the heat exchanger and a strainer (8) removes the residue cleaned and carried by the water. An accumulator (4) is connected in the flow circuit with the regulating valves (31, 32) to absorb shock when the regulating valve (32) is closed and which functions together with the valves (31, 32) to produce a pulsation in the water flowing in the system.

4 Claims, 2 Drawing Sheets

HERMETICALLY SEALED WATER PIPE CLEANING DEVICE

This is a continuation-in-part of application Ser. No. 07/323,418, filed Mar. 14, 1989, now abandoned.

BACKGROUND OF INVENTION

1. Field of the Invention

The present invention relates a device to clean a hermetically sealed water pipe, for example, a pipe for cooling water circulation, etc. in an oil cooler, etc.

2. Description of the Related Art

In the operating sections of working machines employed in various industrial fields including a plastic molding machine and in the operating section of construction machines like a bulldozer, etc., means are employed to operate by utilizing an hydraulic mechanism. Since the hydraulic mechanism is constructed to operate by circulating oil in the piping installed in the mechanism interior as the power source, the temperature of the oil circulating in the piping by the pressurization, is raised. Leaving the oil at a raised temperature not only promotes deterioration of the quality of the oil, but also results in poor operation of the machine (defective molding, etc., cause of oil leakage occurrence and troubles based on the deterioration, etc. of each section packing.) For this reason, the working machine is provided with a mechanism to cool the oil and maintain it at a constant temperature, that is to say, an oil cooler (heat exchanger).

The said oil cooler has an oil inflow orifice al and an oil outflow orifice a2 as exemplified in FIG. 3. A plurality of tubes b . . . b between plates or sheets c are provided in a body having a large outside diameter a (heat exchanger) to circulate cooling water, supplied along a different circuit from the oil, through inlet 61 and outlet 62, separated by a partition 63, so that the oil which comes into contact with exteriors of cooling water pipes b . . . b in the body a (heat exchanger) is cooled. However, in the case of such an oil cooler (heat exchanger), since water is used as the cooling medium, it is likely to be influenced by good or bad water quality, and the following problems have been encountered. That is to say, (1) depending on the cooling water quality or dust, etc. mixed into the cooling water storage tank, fur and/or sludge adheres to the inside of the pipes, or rust forms easily;

(2) by the adhesion of fur and/or sludge and/or rust formation, clogging is produced inside the cooling water pipes;

(3) by the increase in the resistance inside the pipes caused by clogging, the cooling water flow changes, and the cooling effect is reduced (lowering of heat exchange rate); (4) corrosion of water pipes by dust, fur, etc.

As a means to cope with such problems, conventionally a person in charge of the maintenance removes heat exchangers mounted to working machines, construction machines, etc., and removes fur, etc. adhering to the inside of the water pipe and polishes the water pipe inside with a wire brush, etc., but with this method, since heat exchangers have to be removed one by one, much time is required for the removal of heat exchangers. In addition, many workhours being for 3 hours to 4 hours per unit, are lost and further there is the risk of damage to water pipe walls.

As a means to eliminate these defects, a method has been implemented to use chemicals to eliminate sludge in the cooling water circulating inside the water pip and eliminate fur, etc. adhered to water pipe walls but in addition to the fact that a long time is required for the elimination of sludge, since there is a need to increase the concentration of chemicals used to effectively carry out the removal of sludge, problems have been encountered due to the oscillation and corrosion of the metal of the pump and packings, etc. of valves by these chemicals. Further, the cooling water containing chemicals mixed with sludge when discarded produces environmental pollution such as the contamination of rivers, etc., or if these liquids are buried under the ground, the dissolution of chemicals of high concentration does not progress, and they ooze out, causing similar pollution problems.

SUMMARY OF THE INVENTION

The object of the present invention is to provide a water pipe cleaning device that can clean heat exchanger tubes without removing the heat exchangers mounted to the working machines, construction machines, etc. In addition, other objects of the present invention are that the cleaning effect is particularly good irrespective of the fact that the cleaning means is simple, and moreover, to provide a water pipe cleaning device which keeps the cleaning cost extremely low.

A further object of the present invention is to offer a water pipe cleaning device which has a constant cleaning effect of high efficiency even if carried out by beginners in accordance with an operation manual without the need of the skill in the cleaning operation. The present invention achieves these objectives by providing ultrasonic wave generation in the cleaning water mixed with a gas by a gas liquid mixing mechanism to supply high-pressure pulsating water for generating cavitation in the liquid or cleaning water fed out from the mixer to the heat exchanger through a check valve. The cleaning water discharged from the heat exchanger flows back to the water storage tank after eliminating cleaning residues by a strainer, etc.

DESCRIPTION OF PREFERRED EMBODIMENT

Figure 1:
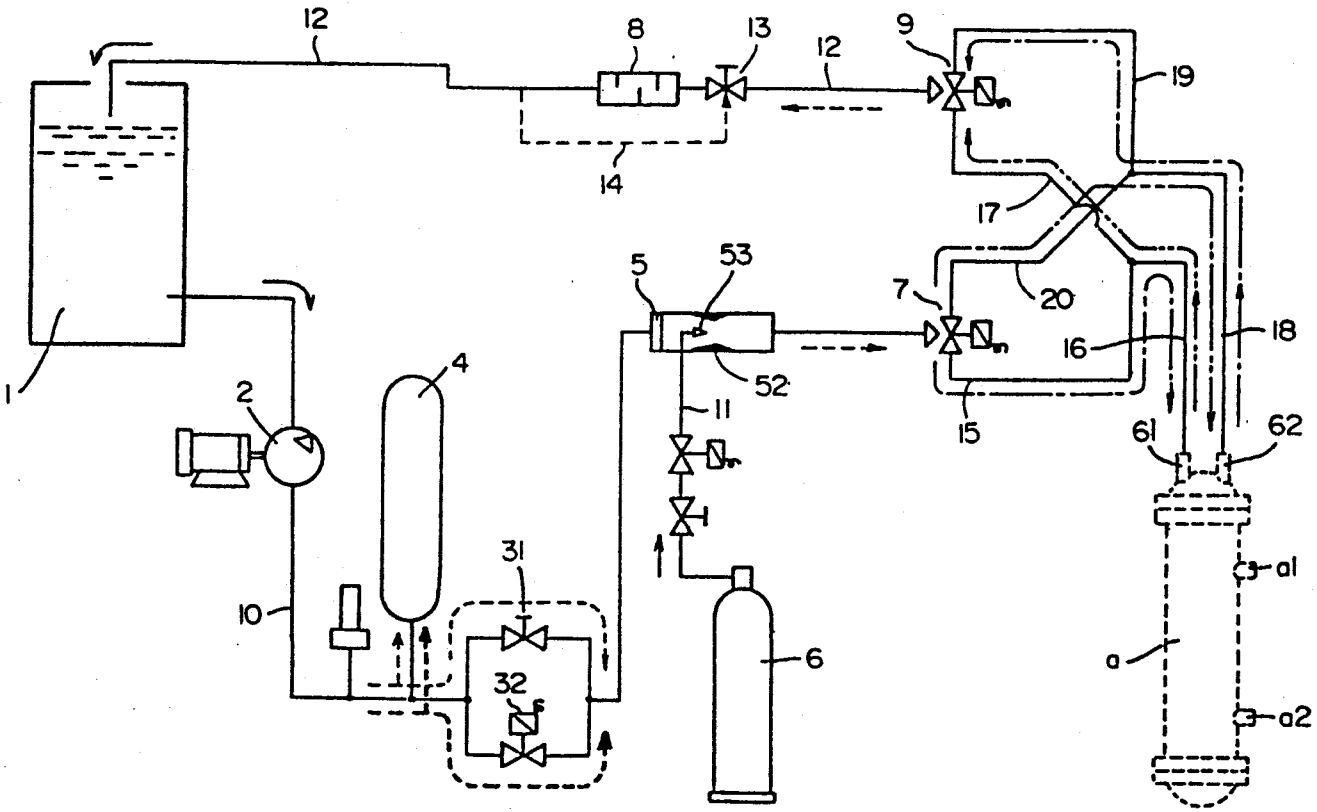
FIG. 1 is a schematic flow diagram showing of the invention and the connection of each element.

In FIG. 1, 1 is a cleaning water storage tank, and is connected to a gas compression pump 2 through suitable piping. The cleaning water supplied to the gas compression pump 2 is pressurized to a predetermined pressure and then fed through piping 10 to a mixer 5 through a pulse generating mechanism for producing a pulsating current by generating alternately a strong and a weak current in the water. The generating mechanism for the pulsating current is constituted by a high-pressure regulating valve 31, a high-pressure release valve 32 in parallel with valve 31 and an accumulator 4 upstream in the piping. The system is designed so that the strong and weak pulsating currents are generated by the combined action of the high-pressure regulating valve 31, the high-pressure release valve 32, and the accumulator 4.

The said generating mechanism of the pulsating current, operates as follows:

Valve 31, which may be a manually controlled valve, is adjusted to an open position to a predetermined extent to maintain a continuous flow therethrough. At the fully open position valve 31 has a flow rate corresponding to the normal output flow rate of high pressure pump 2 with valve 32 closed.

In this case the high-pressure release valve 32 should be in the totally closed state.

The solenoid of valve 32 is operated electrically and sequentially, or alternately in cycles, between open and closed positions so that when valve 32 is fully opened, valves 31 and 32 together conduct water flowing at the discharge flow rate of pump 2, and when valve 32 is fully closed, the cleaning water from pump 2 flows through valve 31 at the flow rate at which valve 31 has been selectively set. The accumulator stores pressure due to the flow rate from the pump exceeding the flow rate of valve 31 during the interim period when valve 32 is closed.

That is to say when valve 32 is open the cleaning water flows out through the high-pressure regulating valve 31, and is discharged through the high-pressure release valve 32 it has the maximum flow rate to the heat exchanger. The accumulator 4 stores the excess pressure produced by pump 2 when the high-pressure release valve 32 is in the totally closed state, since the flow rate through the high-pressure regulating valve 31 is set smaller than the normal discharge flow rate of pump 2, and the flow applied to the high-pressure regulating valve 31 exceeds its capacity. If the discharge of pump 2 is continued under such an flow, water hammer and other shocks produced on the pump 2 by the counterflow, and its proper functioning is stopped.

The accumulator is to store by absorption the shocks as the pump 2 produces the excess flow and pressure given to the high-pressure regulating valve 31 when the high-pressure release valve 32 is in the totally closed state, i.e. the flow is at the set flow rate of high-pressure regulating valve 31, and the flow and resultant pressure is absorbed by the accumulator, so that a pulsating current is generated by the pressure stored in the accumulator 4 discharged when the high-pressure release valve 32 is totally opened.

The gas-liquid mixer 5 is constructed so that it generates ultrasonic waves by mixing the cleaning water, flowing in a pulsating manner from the pulsation generating mechanism, and the gas supplied from a gas cylinder 6 at a specified mixing rate.

Figure 2:
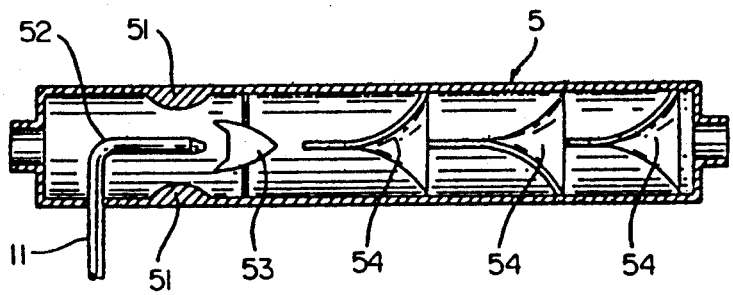
FIG. 2 is an enlarged cross-sectional view showing the inside of the gas-liquid mixer.
Figure 3:
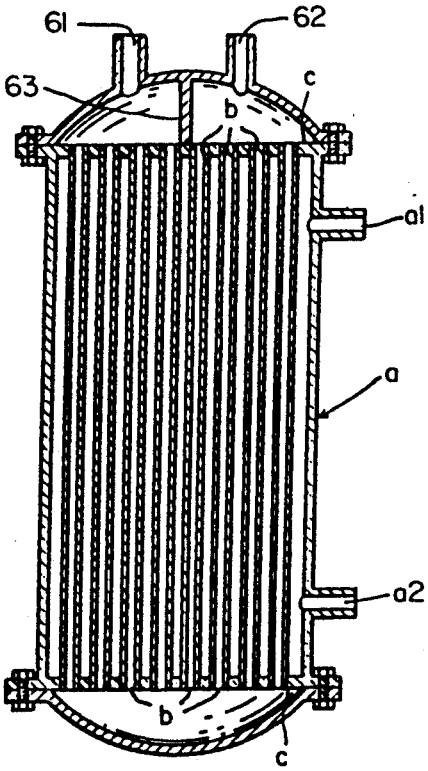
FIG. 3 is a cross-sectional view showing an example of the heat exchanger.

The structure of the gas-liquid mixer 5 is not limited in particular, but an example of the structure is shown in FIG. 2.

The gas-liquid mixer 5 is constructed so that the water current or flow can be accelerated by making a part of the inside diameter in the inflow section of smaller diameter by annular section 51, and positioning a blowout nozzle 52 on the end of a gas line 11 from gas tank 6 in this smaller diameter section 51. Further, by mounting a vibrating cup 53 adjacent the tip section of blowout nozzle 52, an Hartman blow articulator is formed. 54 . . . 54 which are static mixers formed at intervals downstream of the vibrating cup, produce split phenomena of rotation and blowholes or air pockets or air bubbles in the gas-liquid mixed cleaning water flow being passed through the Hartman blow articulator, to obtain a practical cavitation effect (cavitation damage effect) by making air bubbles generated in the cleaning water small. (As the number of static mixers 54 . . . 54 is increased, the number of air bubbles generated by the succeeding mixer 54 is increased successively to the number of 1 times, and the size of air bubbles formed is smaller.)

In this connection, a few static mixers 54 54 installed are set so that the respective positions are orientated to mutually different directions to effectively turn the cleaning water flow and effectively to split air bubbles generated.

7 is a diverter valve to change the inflow direction of cleaning water into heat exchanger a, and is of 3-way valve construction. It is designed so that the cleaning water supplied from the gas-liquid mixer 5 normally flows from an inlet 61 to an outlet 62 installed in the oil cooler a or, flows in reverse from the outlet 62 to the inlet 61, thereby enabling the flow to be both in the normal and reverse direction through the cooler. In this connection, this diverter valve 7 can operate automatically by utilizing a switching circuit (not shown) to operate intermittently.

8 is a strainer, which eliminates by absorption clean residues of fur, sludges, rust, etc. mixed in the cleaning water after being removed from the pipes by the cleaning water circulation, so that only clean cleaning water flows back to the water storage tank 1.

9 is a valve similar to valve 7 and also can be operated automatically by a switching circuit for valve 7 and operates in conjunction therewith to control normal and reverse flow in cooler a as more clearly described below, and downstream of which cleaning water flows back to the water storage tank 1 by means of line 12 through relief bypass valve 13 and strainer 8, or a bypass line 14 which is opened by valve 13 when excessive cleaning residues are adhered to the strainer 8 and the reflux pressure gets too high. Valves 7 and 9 and cooler a are interconnected by flow lines 15, 16, 17, 18, 19 and 20 as shown in FIG. 1 to provide flow in the directions of the arrows as shown.

The present invention as described above operates as follows:

First, remove cooling water supply pipes (both pipes of IN and OUT) connected to the water pipe (for example, oil cooler) to be cleaned and leave these parts connected with the diverter valve 7 and valve 9 as shown in FIG. 1 of the present invention.

In this state, if the operating switch of the device in the present invention (not illustrated) is set in the ON state, the cleaning water in the water storage tank 1 is pumped in the direction of the gas-liquid mixer 5 by the pump 2.

Since downstream of the pump 2 the pulsation generating mechanism produces pulsating water current by the combined effect of high-pressure regulating valve 31, high-pressure release valve 32 and accumulator 4, stronger and weaker water currents are alternately generated, resulting in pulsating water current.

Further, in the gas-liquid mixer 5 the gas for ultrasonic generation is fed from the gas cylinder 6 separately installed to nozzle 52.

After the cleaning water fed to the gas-liquid mixer 5 is mixed with the gas in the acceleration pipe section (smaller diameter 51 section), the gas and the liquid are mixed, crashing in the vibrating cup 53, and generating many air bubbles forming a base of cavitation action.

After many air bubbles are formed, and split into many smaller bubbles in the succeeding static mixtures 54 . . . 54 sections, they pass through the diverter valve 7 with the water, and through the water pipes b . . . b from any one side of the port 61 or 62.

The flowing cleaning water in the water pipes b . . . b exerts the cavitation effect on the pipe walls of the water pipes b by the ultrasonic waves generated when air bubbles inside the cleaning water vibrate and are collapsed (cracked open), which peels and eliminates strongly the fur, sludges, rust, etc. adhered to the pipe walls.

After cleaned residues peeled and eliminated from the water pipes b . . . b by the cavitation effect with ultrasonic waves are filtered by the strainer 8, only clean water flows back again to the water storage tank 1, and this is a continuous operation as long as the cleaning system is operated.

In this connection, since the system has been constructed so that the cleaning water inflow can be switched by connecting the diverter valves 7 and 9 downstream of the gas-liquid mixer 5, the cleaning water flow normally having the inflow path from valve 7 through lines 15 and 16 to the inlet 61 of the cooler a and through cooling water pipes b toward the outlet 62 and lines 18 and 19 and valve 9 to valve 13, can be selected to be in the opposite direction by the switching of the valve 7 together with valve 9, so that the flow path is reversed whereby the flow is from valve 7 through lines 20 and 18 to port 62, through pipes b and out port 61, and through lines 16 and 17 and valve 9 to valve 13, so that more effective cleaning effect is produced. The alternate flows are shown by the dot-dash lines and arrows thereof in FIG. 1.

With the cleaning device of the present invention constituted as described above, the following effects can be accomplished:

(1) Since it is constituted so that the pulsating current generating mechanism is composed of the high-pressure regulating valve 31, the high-pressure release valve 32 and the accumulator 4 between the pump 2 and the gas-liquid mixer 5, the cleaning water fed out from the mixer 5 can be a pulsating water current. In particular, the cleaning water fed out from the gas-liquid mixer 5 is mixed with many air bubbles generated by the mixer 5, and the fur, sludges, rust, etc. adhered to the water pipe wall can be peeled and cleaned forcibly and properly by the cavitation effect with ultrasonic waves generated when vibrations and air bubbles are broken during flow without damaging the quality of the water pipe.

Further, in case the cleaning water flow moving in the water pipe is only the current having a constant pressure, the cleaning effect can be attained only by the cavitation effect by the breaking of air bubbles. Since this invention produces in the cleaning water a pulsating water current or flow, it has made it possible to eliminate more effectively the fur, rust, etc. to be peeled from the pipe wall by the cavitation effect of the vibration and breakage of air bubbles accompanied by the pressure of the pulsating water current.

(2) It is possible to remove completely cleaning residues mixed in the cleaning water by filtration with the strainer 8, which has the economic facility of enabling repeated use of the cleaning water in a predetermined quantity.

(3) In case the flow path of water pipe is long, and the cleaning water flows only one-way, there is the tendency to reduce the cleaning effect in the end section of water pipe, but the present invention overcomes this by the diverter valves 7 and 9 at the back of the gas-liquid mixer 5, so that the cleaning water supply for the water pipes b can be switched to reverse the flow as desired.

(4) There is no need to remove the equipment such as an oil cooler, etc. mounted on the working machine, etc. from the machine body, and also the preparation work is able to be simplified.

(5) For example, when the water pipe of an oil cooler is cleaned by the conventional cleaning means by employing a wire brush, etc., the workhours required are 3 hours to 4 hours, and the cleaning effect is low, but where the cleaning device of this invention is employed, the extremely perfect cleaning can be done in 30 minutes of required time, the cleaning effect is enhanced, and the workhours and cleaning expenses are able to be economized significantly.

(6) Where conventional cleaning means employing a wire brush, etc., are used the water pipe wall is more likely to be broken, but in the present invention the occurrence of such a problem is highly unlikely.

(7) Where the conventional method employing chemicals in the cleaning water is used, there is the tendency of oxidization and corrosion of pump metals, packings, valves, etc., and also secondary environmental pollution due to disposal of chemicals used, but in the present invention only the water itself is used as the cleaning agent, and since the gas used is simply for generation of bubbles, there is no tendency at all to produce functional damages to working devices, etc.

(8) The equipment is simple, and can be compactly constructed.

What is claimed is:

1. A water pipe cleaning system comprising:

a cleaning water storage tank;

pump means having an inlet connected to said storage tank and an outlet;

a high pressure flow regulating valve having an inlet connected to said pump outlet;

a solenoid operated flow control valve connected in parallel with said flow regulating valve and means for operating said flow control valve intermittently between open and closed positions;

an accumulator connected to said pump outlet for absorbing pressure shock when said flow control is closed, so that said pump, valves and accumulator cooperate to produce a flow of cleaning water having a pulsating high pressure therein;

a gas-liquid mixer downstream of said valves for introducing pressurized gas into said flow of cleaning water; and means for connecting said gas-liquid mixer to at least one pipe to be cleaned so that the pulsating flow of said cleaning water through said at least one pipe effects cleaning of the inside thereof.

2. The cleaning system as claimed in claim 1 wherein said means for connecting said gas-liquid mixer to said at least one pipe comprises means for intermittently reversing the direction of flow of cleaning water through said at least one pipe to be cleaning.

3. The cleaning system as claimed in claim 1 and further comprising:

return means for returning cleaning water from said at least one pipe to be cleaned to said storage tank; and strainer means connected to said return means for removing solid impurities from said cleaning water returning to said storage tank after flowing through said at least one pipe to be cleaned.

4. The cleaning system as claimed in claim 2 and further comprising:

return means for returning cleaning water from said at least one pipe to be cleaned to said storage tank; and strainer means connected to said return means for removing said impurities from said cleaning water returning to said storage tank after flowing through said at least one pipe to be cleaned.

* * * * *